US007455593B1

(12) United States Patent
O'Neill

(10) Patent No.: US 7,455,593 B1
(45) Date of Patent: Nov. 25, 2008

(54) LAYBACK SWING AND SWING ATTACHMENT

(76) Inventor: Kevin J. O'Neill, 23 Creekside Dr., Middle Island, NY (US) 11953

( * ) Notice: Subject to any disclaimer, the term of this patent is extended or adjusted under 35 U.S.C. 154(b) by 450 days.

(21) Appl. No.: 11/353,327

(22) Filed: Feb. 14, 2006

(51) Int. Cl.
*A63G 9/12* (2006.01)
*A63G 9/00* (2006.01)

(52) U.S. Cl. ..... 472/118; 297/277

(58) Field of Classification Search ..... None
See application file for complete search history.

(56) References Cited

U.S. PATENT DOCUMENTS

| | | | | | |
|---|---|---|---|---|---|
| 953,591 | A | | 3/1910 | Bringham | |
| 2,080,795 | A | | 5/1937 | Stone | |
| 2,181,063 | A | * | 11/1939 | Miller | 297/281 |
| 2,520,377 | A | | 8/1950 | Schrougham | |
| 3,161,893 | A | * | 12/1964 | Siler | 5/120 |
| 3,459,423 | A | | 8/1969 | Meade | |
| 3,528,657 | A | * | 9/1970 | Krupsky | 472/118 |
| 3,834,757 | A | * | 9/1974 | Krupsky | 297/277 |
| 4,221,429 | A | | 9/1980 | Wade | |
| 4,304,437 | A | | 12/1981 | Longo | |
| 4,456,244 | A | * | 6/1984 | Andrews | 472/124 |
| 4,478,409 | A | | 10/1984 | Eads et al. | |
| 4,693,512 | A | | 9/1987 | Hobson | |
| 4,838,609 | A | * | 6/1989 | Christensen | 297/277 |
| 5,058,951 | A | | 10/1991 | Theil | |
| D364,969 | S | | 12/1995 | Boone | |
| 5,588,702 | A | * | 12/1996 | Litwin | 297/277 |
| 5,944,381 | A | | 8/1999 | Nguyen | |
| 6,343,838 | B1 | | 2/2002 | Bagshaw | |
| 6,364,412 | B1 | | 4/2002 | Crawford | |
| 6,854,801 | B2 | | 2/2005 | Nussbaum | |

* cited by examiner

*Primary Examiner*—Kien T Nguyen
(74) *Attorney, Agent, or Firm*—Island Patent; F. Scott Tierno

(57) ABSTRACT

A layback swing includes an attachment that is coupled to a suspendible swing, either at an end-user location or at a place of manufacture. The layback swing includes two spaced apart curved elongated members having at least one acute bend in each. Also included is a back support portion that extends between a first portion of each included curved elongated member. The curved elongated members and back support portion are included for enabling an individual using the layback swing to safely and securely swing in a layback position. This abstract is provided to comply with rules requiring an abstract, and is submitted with the intention that it will not be used to interpret or limit the scope and meaning of the claims.

22 Claims, 5 Drawing Sheets

LAYBACK SWING AND SWING ATTACHMENT

TECHNICAL FIELD

The present invention relates most generally to suspended recreational swings. More particularly, the invention relates to a layback swing, which may be provided as an attachment that may be coupled to an existing swing, for enabling an individual to be safely supported substantially in a layback position while swinging upon the layback swing.

BACKGROUND

The pleasure obtained with swinging upon a traditional swing is well known in the art. For example, the ubiquitous 'playsets' found in many backyards, which have been available for many years in various incarnations, generally all include one or two common swings. Commonly available swings are typically structured with a plurality of downwardly extending support tethers and a seat. The seat is securely supported by a fixing of a first end of each tether to a side location of the seat or seat portion. The second end of the support tethers are often fixed to an overhead support structure, such as an overhead beam, from which the support tethers may swing back and forth as an individual is seated upon the seat of the swing.

When swinging upon a swing, it is common for an individual, especially when a youth, to swing higher and higher. Essentially, when an individual reaches a forward swinging apex, a substantially 'layback position' may be reached—which is generally quite enjoyable to the individual on the swing. However, to an onlooking parent or baby-sitter, such an activity can be somewhat unnerving. This is especially the case when an excessive forward motion leads to a slackening of the swing's support tethers (e.g., lengths of chain) and a 'snapping' action occurs that may significantly increase the load placed upon each tether. In an effort to enable less vigorous swinging to entertain individuals it would be helpful to provide a means to support an individual swinging upon a swing so that the individual may be safely supported (and somewhat constrained) in a layback position—even when not at the forward apex position of a swing's motion. Indeed, a most desirable structure would be simple, low cost, and actually enable a user to safely swing in a partially or slightly inverted position.

Accordingly, it would be most desirable to provide an improved swing, and or an attachment that may be coupled to an existing suspended swing either at an end user location, such as a park, playground, or backyard, or at a time of manufacture. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF THE INVENTION

In accordance with the present invention, a layback swing is structured for enabling a user to safely and securely swing while supported substantially in a layback position. The layback swing includes a seat portion having a first end and a second end. The seat portion is arranged for sitting upon by a user of the layback swing, and is most preferably provided as a semi-rigid or stiff material. Preferably, at least two spaced support tethers are included, with each tether having a first end and a second end. The first end of one tether is preferably fixedly coupled to the first end of the seat portion, while the first end of another tether is fixedly coupled to the second end of the seat portion. The second end of each tether is typically fixed to an overhead support structure, orienting a significant portion of the support tethers in a substantially vertical position, enabling the layback swing to be supported by the overhead support structure for swinging purposes.

At least two spaced apart curved elongated members are also included. The curved elongated members may be formed having a first (preferably linear) portion, a curved middle portion having an acute angle bend, and a second (preferably linear) portion. When fixed to the swing, a plane established by each curved elongated member is arranged so as to be somewhat substantially vertically oriented. A first end of each curved elongated member is fixedly coupled to one of a tether proximate to the seat portion (and the first end of the tether), or one of the first side or second side of the seat portion. A second end of each curved elongated member is fixedly coupled to a respective tether at a pre-selected location above where the first end is fixedly coupled, and preferably substantially below the second end of the tether.

Accordingly, each curved elongated member is most preferably structured such that a first portion thereof, starting at the first end of the curved elongated member, extends outwardly from a tether/seat side, until reaching the curved middle portion providing a preferably gradual acute angle bend. The curved elongated member is further structured with a second portion that is provided after the curved middle portion and the acute angle bend. The second portion is structured to extend back toward a respective tether for coupling and or fixing thereto at the second end of the curved elongated member.

Additionally included with each layback swing of the invention is a back support portion extending transversely between the first portions of a plurality of curved elongated members. The back support portion may be placed at a selected location between the first end of a curved elongated member and the acute angle bend. Importantly, the curved elongated members and back support portion are included and structured for safely supporting and constraining a user while swinging in a substantially layback position upon the layback swing.

When considering most preferred embodiments of the present invention, the first portion and possibly the second portion of each curved elongated member may be provided as being substantially linear portions. In addition, the back support portion may be formed having a trapezoidal shape, with the back support portion thereby structured with tapered sides. The tapered sides of the back support portion results in a reducing of the spacing between the curved elongated members proximate to the acute angle bends, with respect to the spacing between either one of the first ends and the second ends, of the curved elongated member. When provided having a trapezoidal shape, and with the back support portion being slidably coupled to the curved elongated members, the back support portion may be thereby structured for being placed, by a user or other individual, in a selected position between a retracted position, closer to the seat portion, and an extended position, closer to the acute angle bends.

BRIEF DESCRIPTION OF THE DRAWINGS

In the drawings, like elements are assigned like reference numerals and designations. The drawings are not necessarily to scale, with the emphasis instead placed upon the principles, features, and characteristics of the present invention. Additionally, each of the embodiments depicted are but one of a number of possible arrangements utilizing the fundamental concepts and features of the present invention. The drawings are briefly described as follows.

Figure 1:
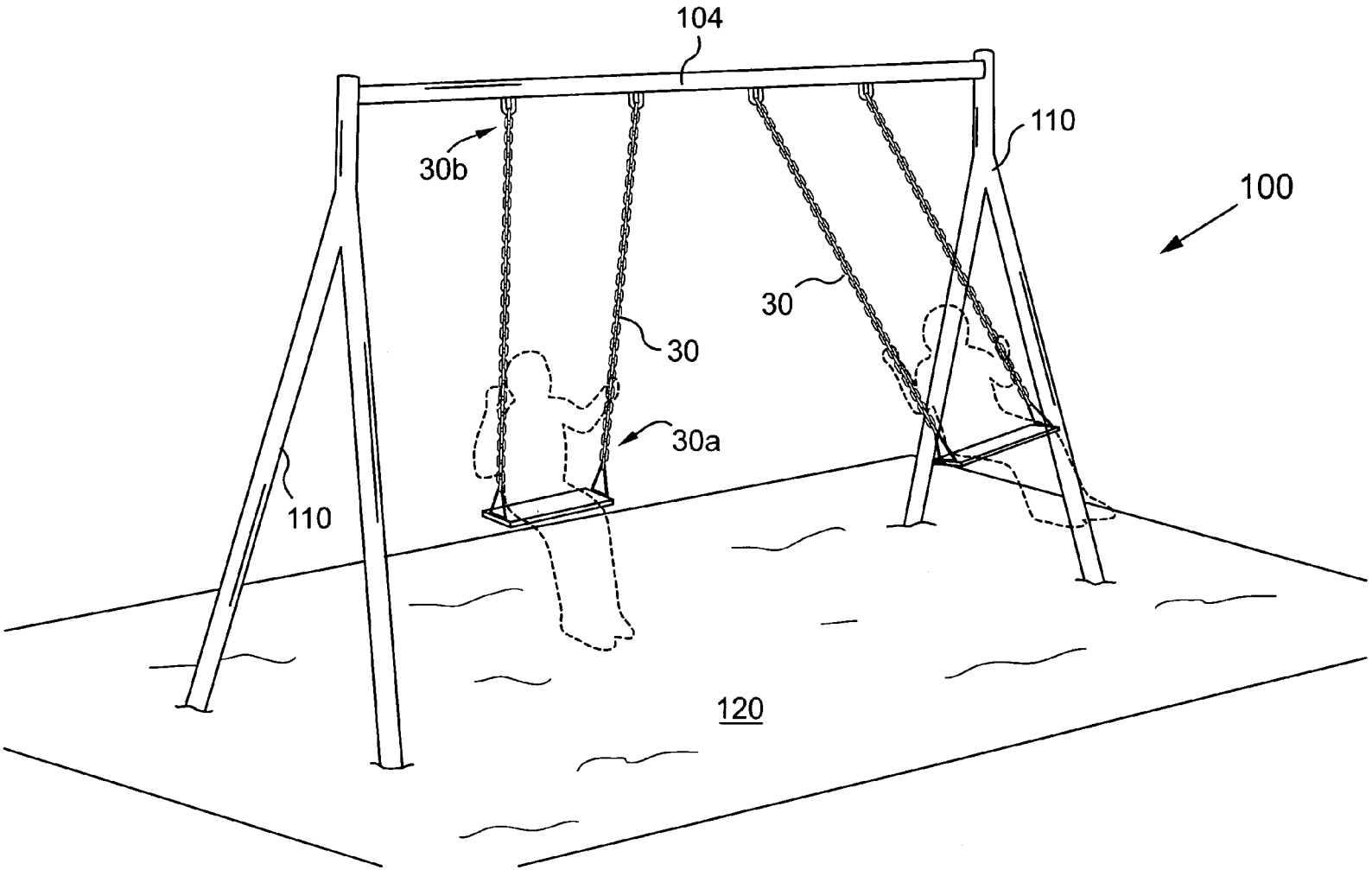
FIG. 1 (Prior Art)
FIG. 1 provides an elevated perspective view of a traditional playground swing set structure that is well known in the art.

| Partial List Of Reference Numerals | |
|---|---|
| 10 | layback swing |
| 12 | seat portion (of a suspended swing) |
| 12a | first end of 12 |
| 12b | second end of 12 |
| 14 | curved elongated member |
| 14a | first end of 14 |
| 14b | second end of 14 |
| 14-1 | first portion of 14 |
| 14-2 | second portion of 14 |
| 20 | back support portion |
| 20a | alternate back support portion |
| 20a-1 | lip portion |
| 22 | foam comfort sleeve |
| 24 | transverse distance or spaced distance |
| 28 | acute angle bend (curved middle portion) |
| 30 | support tether |
| 30a | first end of support tether |
| 30b | second end of support tether |
| 32 | covering sleeve material |
| 34 | fastener (generic) |
| 34a | bolt |
| 34b | nut |
| 40 | first offset bend |
| 44 | second offset bend |
| 46 | bowed (curved) portion |
| 55 | (back support portion) movement arrow |
| 100 | swing set structure |
| 104 | overhead horizontal support member |
| 110 | vertical support structure |
| 120 | ground surface |

DETAILED DESCRIPTION OF EMBODIMENTS OF THE INVENTION

It is important to establish the definition of several descriptive terms and expressions that will be used throughout this disclosure. The term 'tether' may be assumed to be any flexible, strong, and elongate construction including chains, cables, ropes, etc. Indeed, a possibly preferred tether would be constructed of a welded link chain, or a chain structure of equivalent strength. In addition, if chain is employed as the tethers, each chain may have one or more portions of a coextensive plastic outer cover or sleeving disposed thereover. It may be noted that the term tether and support tether may be assumed to be equivalents. When referring to the items such as a seat portion of the swing, and a back support portion, for example, the term 'semi-rigid' may be employed to indicate that a minor and controlled or expected flexing may occur (under normal loading conditions). However, it may also be assumed that these semi-rigid items will substantially hold their shape, even when fully loaded. When discussing and referring to bend angles, such as an 'acute angle bend' of each included curved elongated member, along with any provided 'offset bends', the respective angle is measured as an inside angle, which will be by definition less than 180 degrees in all cases. The term 'layback position', may be assumed to indicate that an individual using the layback swing of the invention may be supported with their torso in a somewhat substantially horizontal position when at the lowest swing point (e.g., tethers orthogonal to the ground surface). Further, as an individual swings forward upon the layback swing, the individual's head may actually be situated closer to the ground or below the rest of the torso of the individual—thereby assuming a slightly or somewhat inverted position upon the swing. The expression 'supporting and constraining', and equivalents, will be used to describe a function and characteristic provided by the structure of the layback swing of the invention. That is, an individual sitting upon the seat portion, may layback upon the back support portion, and will be fully supported and substantially constrained by structures including the curved elongated members, the back support portion, and the seat portion, such that the individual can't easily fall or slip out—even when not holding on with their hands. The term 'fixedly coupled' may be assumed to indicate that a fastening or fixing of one item to another is effected in either a permanent fashion (e.g., a rivet or a non-removable equivalent) or in a removable fashion (e.g., using a common bolt and nut arrangement). Other important terms and definitions will be provided, as they are needed, to properly define the present invention and its associated novel characteristics and features.

Referring now to the drawings, FIG. 1 provides an elevated perspective view of a traditional playground swing set structure 100. The swing set structure 100, which is well known in the art and depicted in but one of many incarnations, includes a pair of vertical support structures 110, which are spaced apart at a pre-selected distance for supporting each end of an overhead (horizontal) support member or structure 104. As shown, the swing set structure 100 is located fixed upon a ground surface 120, which is often provided as dirt, sand, or fine gravel. It may be noted that individuals swinging upon a swing set structure typified by FIG. 1 must generally hold firmly onto the support tethers 30 for assured safety. Letting go could result in a loss of balance and a possibly dangerous fall. As such, the individuals depicted in dotted lines of FIG. 1 are not being supported and constrained, as they are when swinging upon the layback swing of the present invention.

Figure 2:
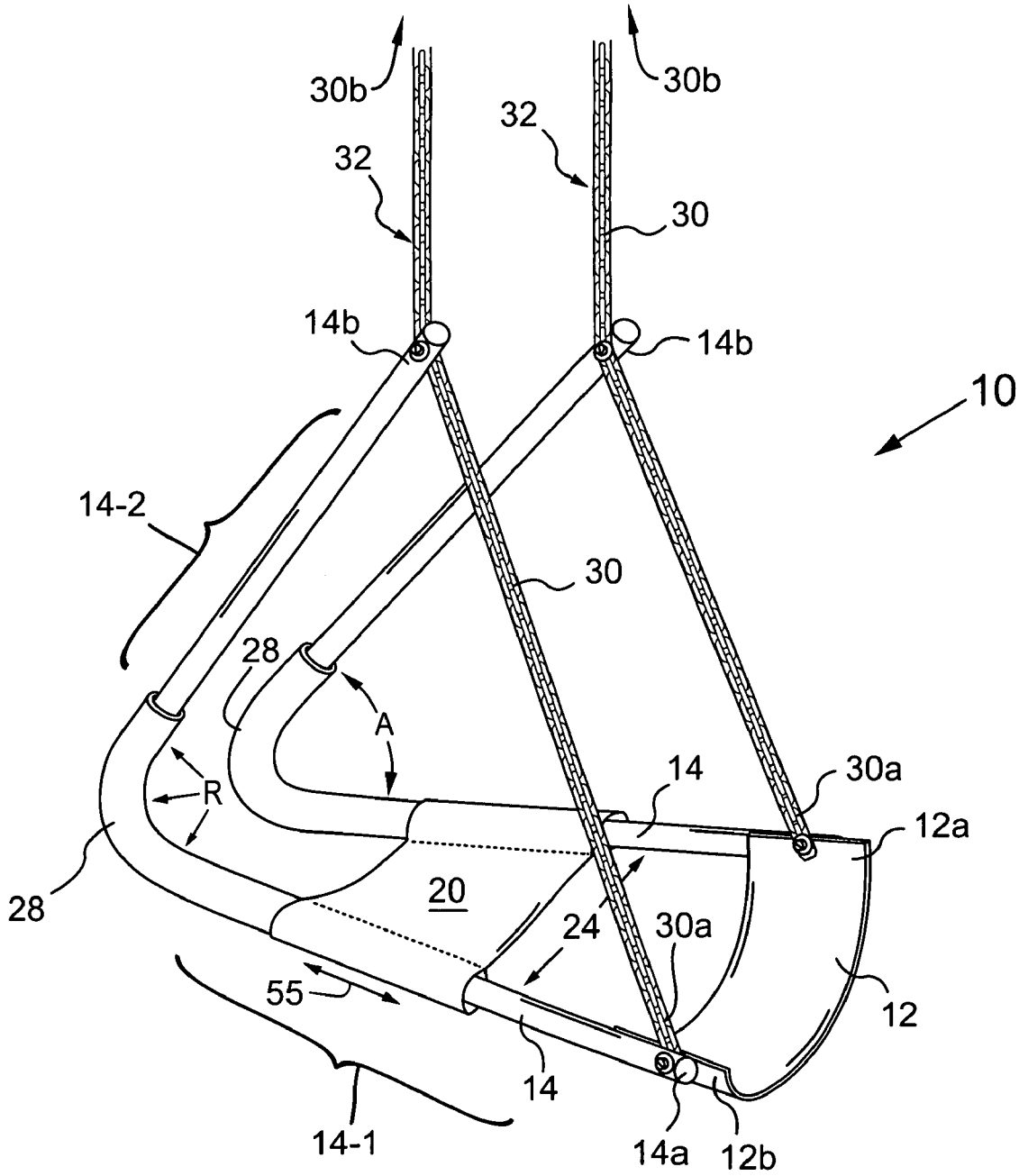
FIG. 2 depicts a side perspective view of a preferred embodiment of a layback swing in accordance with the present invention.

Turning now to FIG. 2, there is illustrated therein a side perspective view of a first preferred embodiment of a layback swing 10, which is structured for enabling a user to safely and securely swing substantially in a layback position. As can be clearly seen in FIG. 2, as well as in the front perspective view of FIG. 3, a seat or seat portion 12 is provided having a first end 12*a* and a second end 12*b*. A most preferred embodiment of the seat portion 12 may preferably be provided as a semi-rigid construction for safety and comfort considerations. As further shown, and fully understood by skilled persons, at least two spaced support tethers 30 may be most preferably provided, with each having a first end 30*a* and a second end 30*b*. Each support tether 30 is further arranged with the first end 30*a* fixedly coupled, respectively, to or proximate to, the first end 12*a* and the second end 12*b* of the seat portion 12. As indicated in FIG. 1, the second end 30*b* of each support tether 30 is typically fixed to an overhead horizontal support 104, enabling the layback swing to be supported by the overhead support structure 104 for swinging purposes. However, when considering the structure of the layback swing of FIGS. 2 and 3, an individual may swing in a substantially layback position, while being supported and constrained from falling. This aspect of the invention, and the associated structures, will be discussed further and in more detail hereinafter.

Turning again to FIGS. 2 and 3, the layback swing 10 most preferably further includes a back support structure having a simple and easy to manufacture design. Accordingly, a preferred embodiment of the layback swing 10 includes at least two substantially matched and spaced apart curved elongated members 14. As shown, each curved elongated member 14 may be fixedly coupled to structures including the seat portion 12 and or a respective support tether 30, causing a plane established by each curved elongated member 14 to be oriented substantially vertically. For example, as illustrated in FIG. 2, the first end 14*a* of a curved elongated member 14 may be fixedly coupled to an end of the seat portion 12, or alternately to a support tether first end 30*a* proximate to the seat portion 12. Further, the second end 14*b* of each curved elongated member 14 may be fixedly coupled to a support tether 30 at a location above where the first end 14*a* is fixedly coupled, and substantially below the second end 30*b* of the tether 30. As such, each curved elongated member 14 (and the acute angle bend thereof) establishes a plane, which is substantially vertically oriented. When considering preferred embodiments consistent with the embodiment of FIGS. 2 and 3, the fixing location for the second end 14*b* of the curved elongated member 14, which is termed 'substantially below the second end 30*b* of the support tether 30', may be assumed to indicate that the fixing location is above the first end 30*a* of the support tether 30, and typically near or below the mid-length point of the respective tether. It may also be noted that the curved elongated members 14, which may best be provided using PVC tubing material, are each also most preferably provided as a semi-rigid or substantially rigid construction.

Figure 3:
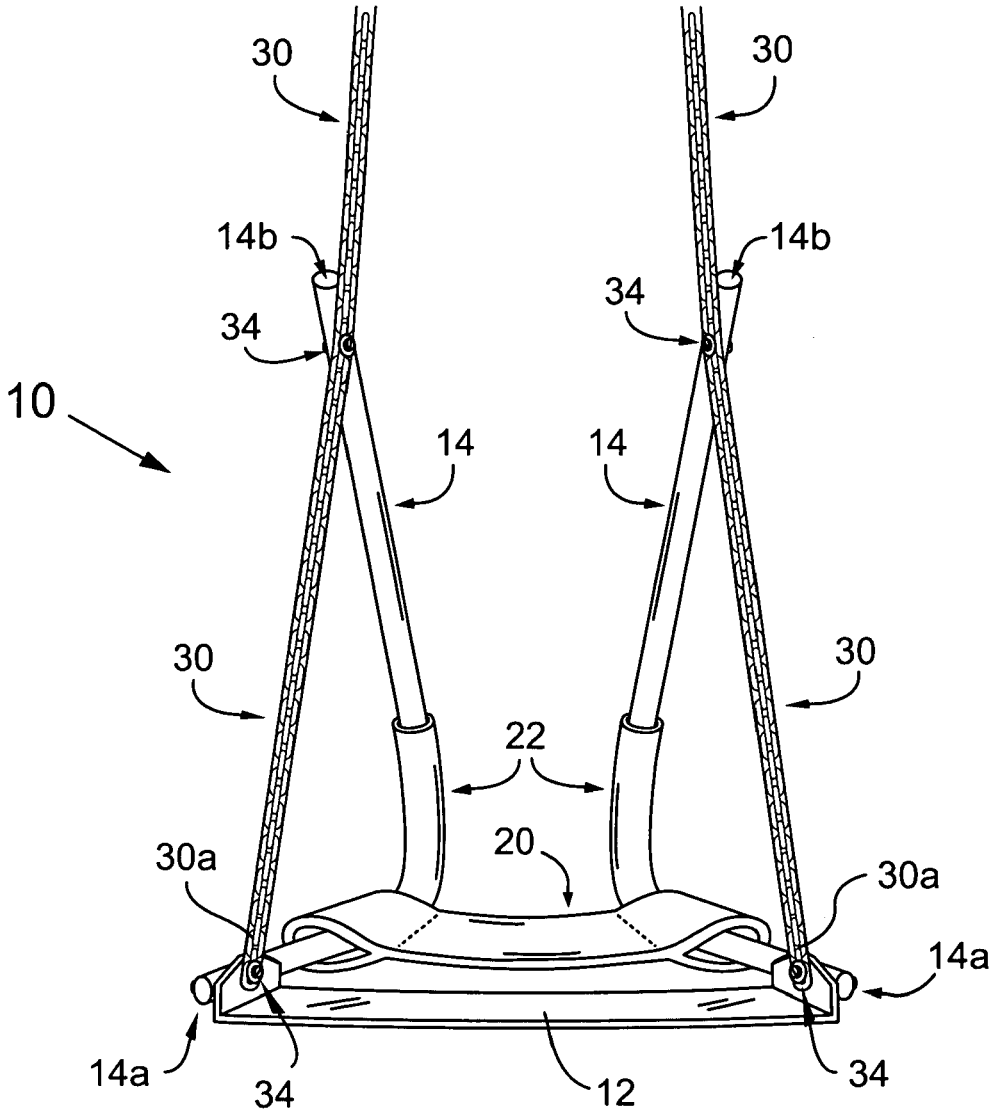
FIG. 3 is a front perspective view of an embodiment of the layback swing of the invention that is consistent with the depiction of FIG. 2.

As clearly shown in FIGS. 2 and 3, each curved elongated member 14 may preferably be structured with a first portion 14-1, starting at the first end 14*a* of the curved elongated member 14, and extending outwardly from the seat portion 12 and or support tether 30 in a substantially horizontal orientation. As depicted, the first portion may be provided as a substantially linear portion of the curved elongated member 14. The first portion 14-1 preferably extends outwardly until reaching a gradual bend formed in the curved elongated member 14, which may be best termed a gradual acute angle bend or simply an acute angle bend 28. The acute angle bend 28 may be preferably provided as a gradual bend, with a bend angle 'A' (see FIG. 2) in the range of 30 to 60 degrees, and with a bend radius 'R' in the range of 3 to 6 inches. A possibly most preferable embodiment of the curved elongated members 14 will be formed with a bend angle A of substantially 45 degrees, with a bend radius R of 4 to 5 inches—to accommodate the shoulders of a user.

Returning again to FIGS. 2 and 3, each curved elongated member 14 may preferably also be structured with a second portion 14-2, which is provided after (or above) the acute angle bend 28, and results in the curved elongated member 14 extending back toward the support tether 30 for coupling thereto at the second end 14*b*. As depicted, the second portion 14-2 may also be provided as a substantially linear portion of a curved elongated member 14.

Figure 4:
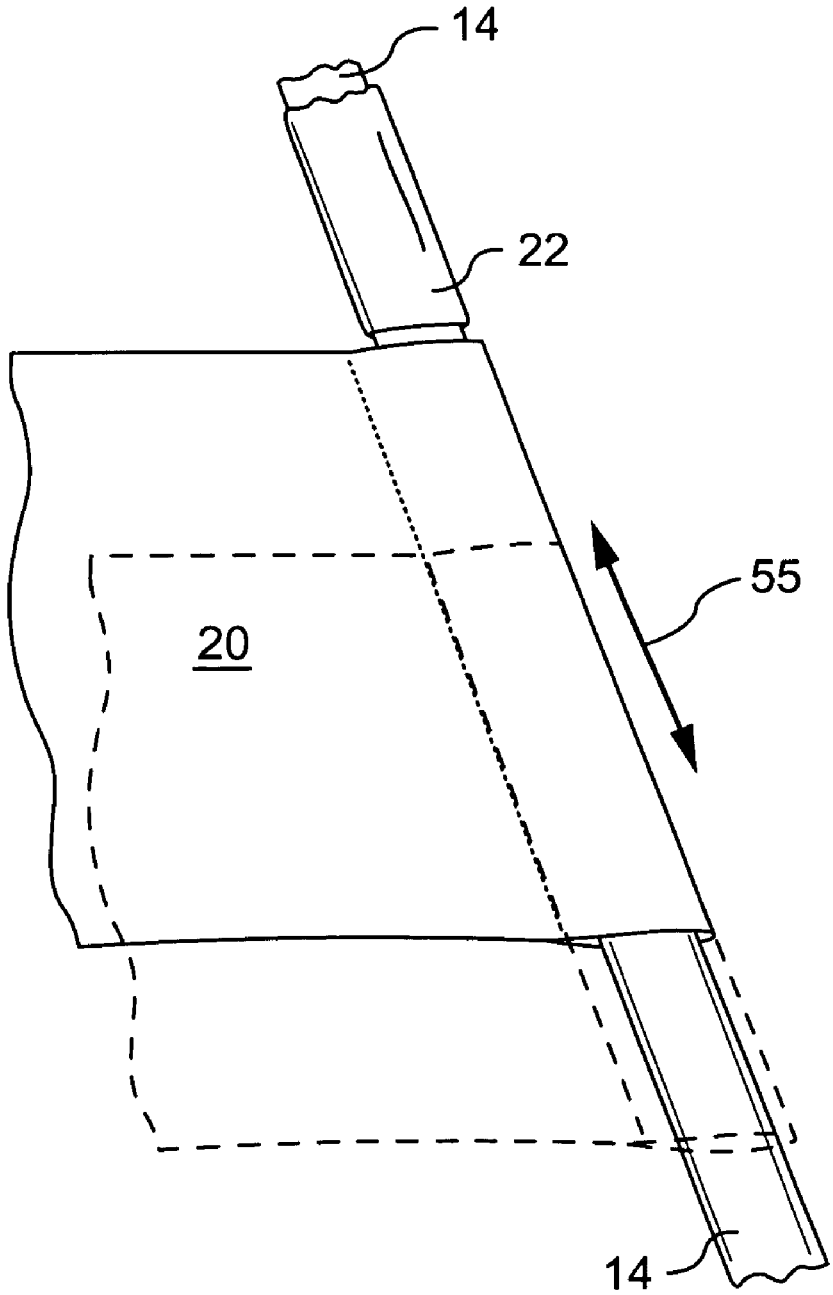
FIG. 4 illustrates a partial top-view of a slidable back support portion positioned in a first position (solid lines) and a second position (dotted lines).

An important function providable by the layback swing 10 is the capability of supporting the back of a torso of an individual swinging upon the layback swing 10 of the present invention. Therefore, the layback swing 10 of the invention requires a structure, which may be termed a back support structure, which as illustrated and described may most preferably include a plurality of curved elongated members 14 and a back support portion 20, or an equivalent structure. For example, as shown in FIGS. 2 through 5B, a back support portion 20 may be provided that extends transversely between the first portions 14-1 of each curved elongated member 14. As shown in FIGS. 2 and 3, a back support portion 20 may be provided for extending between and being suitably coupled or fixed to the first portions 14-1 of each curved elongated member 14. As depicted in FIG. 4, a back support portion 20, which is shown in a partial view, may be arranged to be slidably coupled to each curved elongated member 14 for positioning by a user. As shown in FIG. 4, and as indicated by the motion arrow 55, the back support portion 20 may be placed in any position between an extended position, shown by the solid line, or a retracted position, as shown with dotted lines.

It may also be noted that when the back support portion 20 is provided with a substantially trapezoidal shape, as illustrated in FIGS. 2 through 4, the spaced distance between the curved elongated members 14, for example as measured at the location of the acute angle bends 28, may be substantially different than the spaced distance, as measured at the seat portion 12. For example, as shown in FIG. 2, the spaced distance 24, which is measured at a location proximate to the first ends of the curved elongated members 14, would be noticeably greater than the spaced distance measured proximate to the acute angle bends 28. Also, when embodied with a slidable back support portion, and when the back support portion is moved, say from the extended position to the retracted position (FIG. 4), the spaced distance measured between the acute angle bends 28 of the curved elongated members 14 will also decrease. This may be a useful and important feature, as a positioning of the back support portion in or near the retracted position will accommodate smaller individuals, such as a child, and will bring the curved elongated members 14 closer together, aiding in the safe supporting and constraining of the individual while swinging on the layback swing, in a substantially layback position.

Figure 5A:
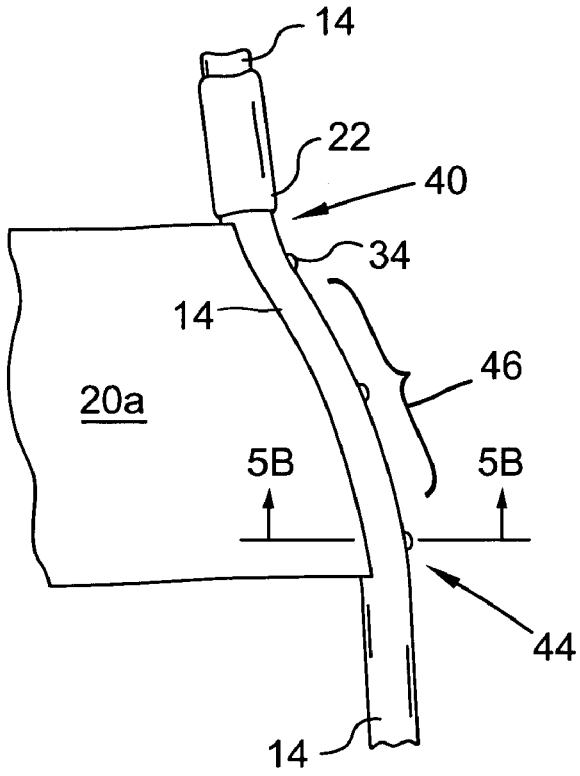
FIGS. 5A and 5B provide an alternate possible structure for the back support portion and a possible mechanical arrangement for fixing the back support portion to a possibly modified curved elongated member by using commonly available fasteners.

As skilled persons will appreciate, the curved elongated members 14 of FIG. 2 and FIG. 3, may be provided as exact copies of each other, with a single monolithic work piece produced and employed at least twice with each layback swing. Alternately, especially when the offset bends of FIG. 5A are included, the curved elongated members 14 may best be described as being what some may term 'mirror images' of each other. In either case, whether two duplicated identical curved elongated members 14 or two mirror image curved elongated members 14, the curved elongated members 14 may be termed 'complementing', with the gradual acute angle bend 28 of each being substantially identical. It may be noted that the portion of the curved elongated member 14 where the acute angle bend 28 is formed may be equivalently termed a 'curved middle portion' of this member. Further, the curved middle portion may provide the acute angle bend as several partial and gradual bends (not explicitly illustrated) that when taken collectively provide the acute angle bend 28.

Another feature that may be provided for additional comfort and safety is best seen in FIGS. 2 and 3. As shown, a preferably foam comfort sleeve 22 may be provided over one or more portions of each curved elongated member 14. The comfort sleeves 22, or any other equivalent cushioning means, may increase comfort and also possibly provide an additional level of friction to aid in supporting and constraining the individual while swinging upon a layback swing. In addition, as skilled persons will understand, portions of the curved elongated members 14 may also be wrapped or coextensively covered with any of a variety of 'grip enhancing materials'—much like a fishing pole or handle bar of a bicycle may be covered to provide a better, possibly non-slip, grasping surface.

It must be understood that the back support structure, including depicted curved elongated members 14 and the back support portion 20, may certainly be provided in other varied embodiments, which may differ structurally with the embodiments of FIGS. 2 through 4. As an example, a back support portion may be provided that is not adjustable and slidably fixed to the curved elongated members 14, and may further be provided in other non-trapezoidal shapes. Consider the depictions of FIGS. 5A and 5B. A modified back support portion 20*a* may be provided with additional structural features (e.g., the curved lip portion 20*a*-1 of FIG. 5B), providing for rigidly fixing the back support portion 20*a*, or an equivalent structure, to the curved elongated members 14. As understood by skilled persons, the back support portion may be taller or longer than depicted in FIG. 5A, and may be molded to include a variety of curved surfaces.

Figure 5B:
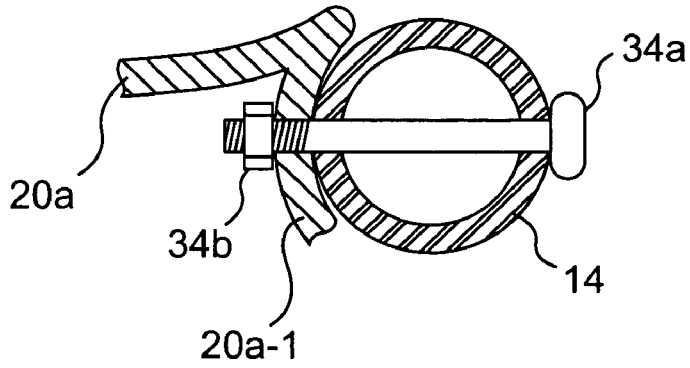

Additionally illustrated in FIGS. 5A and 5B are common mechanical fasteners 34, which may be provided by a bolt 34*a* and a nut 34*b*, at minimum. In addition, as depicted in FIGS. 2 and 3, the couplings of the first ends 14*a* and the second ends 14*b* of each included curved elongated member 14 may also be realized by employing mechanical nuts, bolts, and washers, or possibly well known rivet or fixed type fasteners. Those skilled in the art could certainly provide adequate and alternative mechanical fastening arrangements, possibly employing yet other mechanical fastening means and structures for fastening items such as the curved elongated members 14, the seat portion 12, and the back support portion 20.

The structures described herein may be provided by a wide variety of suitable materials. For example, the seat portion 12, the curved elongated members 14, back support portions 20, etc., and equivalents thereto, may be provided by materials possibly including at least one of rubber, plastic, metal, and wood, or possibly of a known composite material such as fiberglass. As an example, it is contemplated that embodiments of the curved elongated members 14 may be best formed by polyvinyl chloride (PVC) tubing—as depicted in FIG. 5B. Importantly, the most preferred and appropriate materials may very well be determined based on the environmental conditions of a particular site. For example, the materials employed at an ocean front playground, say in a southern climate, would most likely be quite different than the materials employed at a northern mountaintop campground. Indeed, in some cases the material employed may be selected, and colored to match other items of the play-set, or in the yard.

When considering the support tethers 30, a number of possible materials may be employed. As depicted in FIGS. 1 through 3, the tethers may be provided by pre-determined lengths of commonly available chain, such as welded link chain. If a chain is employed, a plastic sleeving 32 (see FIG. 2) or an equivalent coating may be used to cover or sheath the chain. Alternately, the support tethers 30 may be provided by a suitable length of rope, cable, strapping, etc.

Returning again to FIG. 5A, another feature that may be provided by preferred embodiments of the curved elongated members 14 can be seen. As shown, at least one bend, which may be slight and having a bend direction that is provided substantially orthogonal to a plane established by the acute angle bend 28 and the first and second portions of a curved elongated member 14. For example, as seen in FIG. 5A, at least one of a first offset bend 40, a second offset bend 44, and a bowed portion 46, may be provided with other embodiments of the invention. Offset bends, possibly including complementing bends provided on each (opposing) curved elongated member 14, and possible arched or bowed portions 46, may be preferably based upon, or related to, a particular back support structure employed. Further, most preferred offset bends will be minor bends, and typically provided as bends having a bend angle in the range of 150 to 170 degrees (which provides a very slight bend or deviation).

When considering the present invention, it must be understood that embodiments may be provided as depicted in FIGS. 2 through 5B, wherein a complete unit is provided that represents a complete, possibly pre-assembled layback swing 10. Alternately, portions such as the curved elongated members 14 and a back support portion 20 may be added to, or 'attached to' an existing swing. This latter arrangement, wherein for example a kit may be provided that includes the curved elongated members 14, a back support portion 20, and other possible items such as mechanical fasteners 34, may be termed a 'swing attachment'. Accordingly, when the swing attachment of the present invention is attached and or fixed to a traditional swing, the swing is converted to a layback swing, wherein an individual may then swing in a layback position, while being safely supported and constrained (from falling).

While there have been described herein a plurality of the currently preferred embodiments of the methods and or means of the present invention, those skilled in the art will recognize that other and further modifications may be made without departing from the invention. As such, the foregoing descriptions of the specific embodiments of the present invention have been presented for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A layback swing structured for enabling a user to safely and securely swing while supported substantially in a layback position, the layback swing comprising:

a) a seat portion having a first end and second end, with the seat portion structured for sitting upon by a user;

b) at least two spaced support tethers, with each support tether having a first end and a second end, and arranged with the first end of each support tether fixedly coupled to the first end of the seat portion and the second end of the seat portion, respectively;

c) with the second end of each support tether available for fixing to an overhead support structure enabling the layback swing to be supported by the overhead support structure for swinging therefrom;

d) at least two spaced apart curved elongated members, with a plane established by each curved elongated member arranged so as to be vertically oriented, with a first end of each curved elongated member fixedly coupled to one of:

i) a support tether proximate to the seat portion and the first end of the tether; and ii) one of the first side and second side of the seat portion;

e) while a second end of each curved elongated member is fixedly coupled to a support tether at a pre-selected location above where the first end is fixedly coupled, and substantially below the second end of the support tether;

f) with each curved elongated member structured such that a first portion thereof, starting at the first end of the curved elongated member, extends outwardly from a support tether, until reaching a gradual acute angle bend formed in the curved elongated member, and is further structured with a second portion of the curved elongated member that is provided after the acute angle bend, extending back toward the support tether for coupling thereto at the second end of the curved elongated member; and g) a back support portion extending transversely between the first portions of each curved elongated member, at a selected location between the first end of a curved elongated member and the acute angle bend formed therein;

h) with the curved elongated members and back support portion structured for safely supporting and constraining a user while swinging in a substantially layback position upon layback swing.

2. The layback swing in accordance with claim 1, wherein each of the seat portion and a back support portion are provided by a semi-rigid material.

3. The layback swing in accordance with claim 1, wherein each of the first portion and the second portion of each curved elongated member are provided as being substantially linear portions.

4. The layback swing in accordance with claim 3, wherein the back support portion is formed having a trapezoidal shape, with the back support portion thereby structured with tapered sides causing a reducing of the spacing between the curved elongated members proximate to the acute angle bends, with respect to the spacing between either one of the first ends, and the second ends, of the curved elongated members.

5. The layback swing in accordance with claim 4, wherein the back support portion is slidably coupled to the curved elongated member and arranged for sliding along the first portion of each curved elongated member, such that an individual may move the back support portion to a selected position between a retracted position, closer to the seat portion, and an extended position, closer to the acute angle bends.

6. The layback swing in accordance with claim 1, wherein the support tethers are each provided as a length of chain arranged with a coextensive plastic cover sleeving.

7. The layback swing in accordance with claim 1, wherein the coupling of the first and second ends of each included curved elongated member is realized by employing a mechanical fastening arrangement.

8. A layback swing having a semi-rigid seat portion and a semi-rigid back support portion structured for enabling a user to safely and securely swing while in a layback position, the layback swing comprising:

a) a plurality of support tethers having a first end and a second end with the second end of each support tether available for spaced fixing to an overhead support structure for hanging substantially vertically therefrom;

b) the seat portion having a first end and a second end, with the first end of the seat portion fixedly coupled to the first end of at least one support tether, while the second end of the seat portion is fixedly coupled to the first end of at least one other tether, of the plurality of support tethers;

c) at least two complementing and spaced apart curved elongated members, with each curved elongated member formed of a first portion, which starts at a first end of the curved elongated member, and a second portion, which ends at a second end of the curved elongated member, with the first portion coupled to the second portion by way of a curved middle portion providing, by way of at least one included bend, an acute angle bend;

d) with a first end of each curved elongated member fixedly coupled to a side of the seat portion, while a second end of each curved elongated member is fixedly coupled to a pre-selected support tether at a pre-selected location substantially below the second end of the support tether;

e) with each curved elongated member thereby structured such that a first portion thereof, starting at the first end of the curved elongated member, is arranged for extending away from and behind the seat portion with a substantially horizontal orientation, until reaching the curved middle portion and the acute angle bend formed in the curved elongated member; and f) the back support portion structured for extending between and coupling to each included curved elongated member at a selected location between the first end of an elongated member and the curved middle portion;

g) with the curved elongated members, back support portion, and seat portion structured of a semi-rigid material and arranged for safely supporting and constraining a user while swinging on the layback swing in a substantially layback position.

9. The layback swing in accordance with claim 8, wherein the semi-rigid back support portion is slidably supported by and coupled to the curved elongated members such that an individual may place the slidable back support portion in a selected position between a retracted position and an extended position.

10. The layback swing in accordance with claim 8, wherein the back support portion is formed having a trapezoidal shape, such that the back support portion has tapered sides causing a reducing of the spacing between the curved elongated members proximate to the acute angle bends with respect to the distance between the first ends or the second ends of the spaced curved elongated members.

11. The layback swing in accordance with claim 8, wherein each curved elongated member is formed of a polyvinyl chloride tubing material.

12. The layback swing in accordance with claim 11, wherein a substantial portion of each curved elongated member proximate to and including the curved middle portion is covered by a foam cushioning material.

13. A swing attachment structured for being coupled to a suspended swing having a seat portion supported by a plurality of vertically oriented tethers, wherein the swing attachment enables an individual using the swing to additionally swing in a layback position, the swing attachment comprising:

a) a plurality of spaced curved elongated members, with each curved elongated member including a gradual acute angle bend, and further structured having a first end and a second end;

b) a back support portion extending between and coupled to at least two curved elongated members at a pre-selected location between the first end and the acute angle bend of a curved elongated member;

c) with the first end of each curved elongated member adapted to be fixedly coupled to one of:

i) a lower portion of one of the support tethers supporting the seat portion of the swing; and ii) a selected side of the seat portion;

d) while the second end of each curved elongated member is coupled to a support tether at a pre-selected location above the seat portion and below the second end of the support tether;

e) wherein the curved elongated members and back support portion support and constrain an upper body torso portion of an individual swinging upon the layback swing in a layback position.

14. The swing attachment in accordance with claim 13, wherein the seat portion, the back support portion, and the curved elongated members, are each formed of a semi-rigid material that will substantially hold shape while an individual is swinging upon the layback swing.

15. The swing attachment in accordance with claim 13, wherein each end of each curved elongated member is coupled to at least one of a support tether and the seat portion by way of a mechanical fastening arrangement.

16. A swing attachment structured for being coupled to a suspended swing structured with a plurality of support tethers and a seat portion, the swing attachment comprising:

a) two spaced apart curved elongated members, with each curved elongated member formed having a first end and second end, and further including an acute angle bend, wherein the acute angle bend is formed between a first portion and a second portion of the curved elongated member, with each first portion starting at the first end and each second portion ending at the second end of each respective curved elongated member;

b) means to couple the first ends of the curved elongated members, such that the first ends are fixedly coupled to either one of a side of the seat portion and a support tether proximate to the first end of each support tether, with the first portions arranged for extending substantially horizontally outwardly from the seat portion;

c) means to fixedly couple the second ends of the curved elongated members to a pre-selected support tether at a pre-selected location substantially below the second end of the support tether; and d) a back support portion extending between and supported by the first portions of each curved elongated member such that the back support portion spans a portion of an area established between the curved elongated members substantially between the first end and the acute angle bend of each curved elongated member;

e) with the back support portion and curved elongated members structured for supporting and constraining an upper body portion of an individual in a substantially layback position while swinging upon a swing to which the swing attachment has been coupled.

17. The swing attachment in accordance with claim 16, wherein each curved elongated member is formed of a single length of polyvinyl chloride tubing.

18. The swing attachment in accordance with claim 17, wherein the curved elongated members are provided as a pair of complementing curved elongated members.

19. The swing attachment in accordance with claim 16, wherein the acute angle bend provided with each curved elongated member is formed having a bend angle of 30 to 60 degrees and a bend radius in the range of 3 to 6 inches.

20. The layback swing in accordance with claim 16, wherein the back support portion is formed having a trapezoidal shape, such that the back support portion has tapered sides causing a reducing of the spacing between the curved elongated members proximate to the acute angle bend portions when compared to the distance between either of the first ends, and the second ends, of the curved elongated members.

21. The swing attachment in accordance with claim 16, wherein each curved elongated member further includes at least one offset bend provided at an angle substantially orthogonal to a plane established by the acute angle bend of a curved elongated member.

22. The swing attachment in accordance with claim 21, wherein each included offset bend is provided having an angle in the range of 150 to 170 degrees.

* * * * *